US009956532B2

(12) United States Patent
Haden et al.

(10) Patent No.: US 9,956,532 B2
(45) Date of Patent: May 1, 2018

(54) APPARATUS AND METHOD FOR GENERATING SWIRLING FLOW

(71) Applicant: U.S. Department of Energy, Washington, DC (US)

(72) Inventors: Robert E. Haden, North Huntingdon, PA (US); Donald G. Lorentz, Jeannette, PA (US)

(73) Assignee: U.S. Department of Energy, Washington, DC (US)

( * ) Notice: Subject to any disclaimer, the term of this patent is extended or adjusted under 35 U.S.C. 154(b) by 47 days.

(21) Appl. No.: 14/534,263

(22) Filed: Nov. 6, 2014

(65) Prior Publication Data

US 2015/0124554 A1 May 7, 2015

Related U.S. Application Data

(60) Provisional application No. 61/901,251, filed on Nov. 7, 2013.

(51) Int. Cl.
*B01F 3/08* (2006.01)
*B01F 5/00* (2006.01)

(52) U.S. Cl.
CPC ..... *B01F 3/0865* (2013.01); *B01F 5/0057* (2013.01); *B01F 2215/0409* (2013.01); *B01F 2215/0431* (2013.01); *B01F 2215/0481* (2013.01)

(58) Field of Classification Search
CPC ..... B01J 19/26; B01F 3/0865
USPC ..... 366/163.2, 165.1, 165.2, 165.4, 165.5; 137/812–813
See application file for complete search history.

(56) References Cited

U.S. PATENT DOCUMENTS 3,781,320 A * 12/1973 Irwin ..... B01J 19/1881 366/136
3,876,753 A * 4/1975 Manganaro ..... B01J 12/00 422/199
4,097,366 A * 6/1978 Tanaka ..... B01J 8/0278 208/127
4,157,304 A * 6/1979 Molvar ..... B01F 3/04099 210/220
4,186,772 A * 2/1980 Handleman ..... A62C 31/12 137/891
4,210,534 A * 7/1980 Molvar ..... B01F 3/0446 210/220
4,344,752 A * 8/1982 Gallagher, Jr. ..... B01F 5/0413 137/888
4,416,610 A * 11/1983 Gallagher, Jr. ..... B01F 5/0413 137/888
5,139,625 A * 8/1992 Tanaka ..... B01F 5/0413 204/273

(Continued)

*Primary Examiner* — Abbas Rashid
(74) *Attorney, Agent, or Firm* — Jennifer R. Mahalingappa; Robert T. Burns; Brian J. Lally

(57) ABSTRACT

An apparatus and method for generating a swirl is disclosed that is used to induce an axi-symmetric swirling flow to an incoming flow. The disclosed subject matter induces a uniform and axi-symmetric swirl, circumferentially around a discharge location, thus imparting a more accurate, repeatable, continuous, and controllable swirl and mixing condition of interest. Moreover, the disclosed subject matter performs the swirl injection at a lower pressure drop in comparison to a more traditional methods and devices.

9 Claims, 12 Drawing Sheets

(56) References Cited

U.S. PATENT DOCUMENTS

| | | | | | |
|---|---|---|---|---|---|
| 5,169,293 | A * | 12/1992 | Yamamoto | B01F 3/0876 | 210/758 |
| 5,171,090 | A * | 12/1992 | Wiemers | B01F 5/061 | 366/163.2 |
| 5,452,955 | A * | 9/1995 | Lundstrom | B01F 3/0861 | 137/888 |
| 6,523,991 | B1 * | 2/2003 | Maklad | B01F 5/0403 | 137/889 |
| 7,040,551 | B2 * | 5/2006 | Rummel | B01F 5/0406 | 239/135 |
| 7,059,591 | B2 * | 6/2006 | Bortkevitch | B01F 3/0446 | 261/76 |
| 7,776,213 | B2 * | 8/2010 | Arnaud | B01D 21/2433 | 137/888 |
| 8,033,714 | B2 * | 10/2011 | Nishioka | B01D 53/8631 | 137/888 |
| 8,192,070 | B2 * | 6/2012 | Allen | B01F 3/1228 | 366/132 |
| 8,550,693 | B2 * | 10/2013 | Fisenko | B01F 3/0807 | 366/163.2 |
| 2004/0052155 | A1 * | 3/2004 | Fabries | A01C 23/042 | 366/163.2 |
| 2004/0056112 | A1 * | 3/2004 | Faye | B01F 5/0413 | 239/424 |
| 2007/0187372 | A1 * | 8/2007 | Rabinovich | B01J 6/008 | 219/121.36 |
| 2008/0069744 | A1 * | 3/2008 | Machida | B01J 4/002 | 422/186.04 |
| 2010/0041914 | A1 * | 2/2010 | Woelfert | C07C 263/10 | 560/347 |
| 2012/0103546 | A1 * | 5/2012 | Maniere | B01F 3/0807 | 162/158 |

* cited by examiner

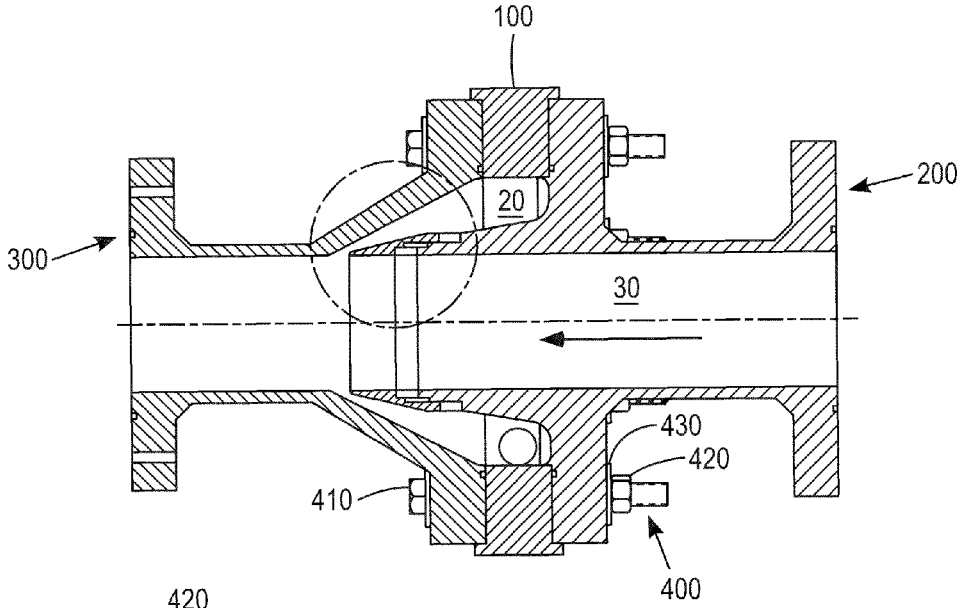
FIG. 5A
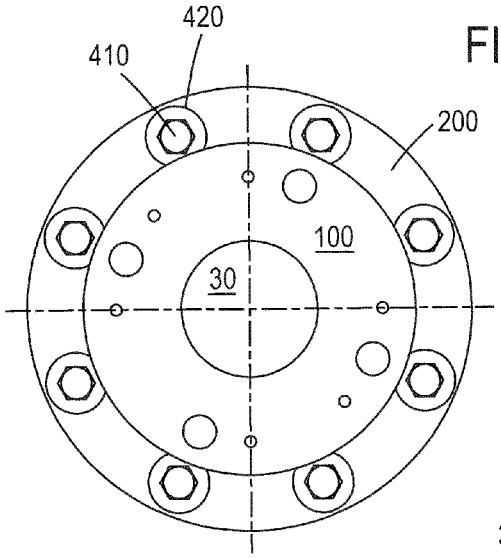
FIG. 5B
FIG. 5C
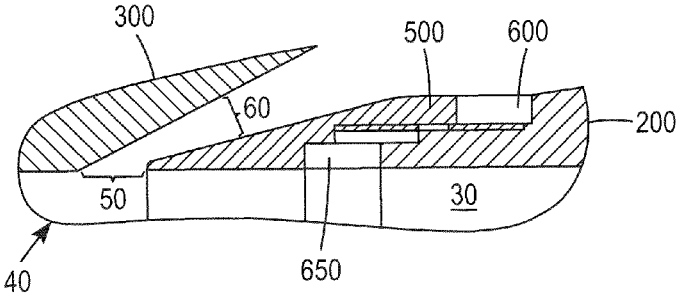

APPARATUS AND METHOD FOR GENERATING SWIRLING FLOW

RELATION TO OTHER APPLICATIONS

This patent application claims priority to U.S. Provisional Patent Application No. 61/901,251, filed Nov. 7, 2013.

GOVERNMENT INTERESTS

The United States Government has rights in this invention pursuant to U.S. Department of Energy Contract No. DE-NR0000031.

BACKGROUND

Technical Field

The embodiments herein generally relate to fluid hydraulic system design, and, more particularly, to combining at least two miscible fluids through a controlled uniform and axi-symmetric mixing of such fluids.

Description of the Related Art

In conventional fluid hydraulic system design, induction of a swirl into a main flow of a fluid typically use conventional tangential injection methods, which are characterized by utilizing numerous tangential injection ports (e.g., 1, 2, 3, 4 or more), stirred tank methods or swirl vane devices. For example, a conventional Quad-Port tangential injection device and a streamline plot of its swirl pattern is shown in FIG. 1. These conventional methods and devices impart less-than-perfectly-uniform swirl rotational pattern downstream from the swirl induction. FIG. 2 illustrates a swirl rotational pattern taken 1.111 m downstream from the Quad-Port tangential injection device shown in FIG. 1. Similarly, FIG. 3 illustrates a swirl rotational pattern from a swirl vane device. In general, however, the relative strength of the swirl (the thus the swirl pattern itself) exponentially attenuates as in passes downstream. These conventional swirl generators are unable to reliably provide desired axi-symmetric and uniform flow fields. Additionally, conventional devices and method used for inducing a swirl into a fluidic flow are unable to predictably meter (i.e., control) the mixing characteristics of the swirl generator. Such conventional swirl generators produce an inconsistent and insufficient axially symmetric swirl flow to the incoming inlet flow. The resultant swirl remains inconsistent and insufficient over a suitable downstream distance from the injection location.

Moreover, conventional swirl generators require significant calibration, unique to each test configuration, of the entire apparatus to produce the desired swirl characteristics. For example, to modify the swirl flow intensities from a swirl vane, the entire swirl vane device requires replacement. Swirl vanes and other conventional swirl generators also introduce substantial pressure drops to fluid systems where the swirl is introduced.

What is desired is a uniform axi-symmetric swirling flow; for example, mixing and stirring for process flow engineering. Furthermore, is it desirable that such a swirling flow be predictable and does not introduce a substantial pressure drop to the system.

SUMMARY

In view of the foregoing, an embodiment herein provides a swirl generator, comprising: a central chamber; an upstream nozzle connecting with an first end of the central chamber; a conical downstream nozzle connecting with a second end of the central chamber; and at least one injector having: a plenum having a plenum inlet and a plenum discharge; a slot connecting at a first end with the plenum discharge and connecting radially tangentially at a second end with the central chamber; and a plenum feed connecting with the plenum inlet. Such a system may further comprise: an inner spacer connected to an outer surface of the conical downstream nozzle; and an outer spacer connected to an inner surface of the conical downstream nozzle, wherein the inner and outer spacers forming a throat and defining a gap between a downstream edge cone surface and an inner surface of the downstream nozzle. Additionally, such a system may further comprise a thermally conductive jacket connecting with the central chamber.

In addition, embodiments herein include a method of generating an axially-symmetric swirling flow that comprises feeding a first flow into a plenum; discharging the first flow from the plenum into a converging gap; and radially tangentially discharging the first flow from the converging gap into a main flow. Such a method may further comprise feeding the first flow into the plenum in a direction perpendicular to the main flow. Additionally, the method may further comprise reducing a hydraulic diameter of the discharge gap. Moreover, the method may further comprise adding a first chemical reactant to the plenum. Furthermore, the method may further comprise adding a second chemical reactant to the main flow.

Additional embodiments disclosed herein provide a method of creating an axially-symmetric swirling flow, comprising: passing a main flow through a chamber having an upstream nozzle and a downstream nozzle; injecting a second flow into a plenum; passing the second flow from the plenum into a slot connecting at a first end with the plenum and connecting radially tangentially at a second end with the chamber; and mixing the second flow with the main flow. Such a method may further comprise injecting the second flow into the plenum in a direction perpendicular to the main flow. That method may further comprise reducing a hydraulic diameter of the downstream nozzle. Moreover, that method may further comprise adding a first chemical reactant to the plenum and may further comprise adding a second chemical reactant to the main flow. In addition, the method may further comprises discharging the first flow from the plenum into a converging gap and may further comprise reducing a hydraulic diameter of the discharge gap and may increase a velocity of the axially-symmetric swirling flow when a hydraulic diameter of the discharge gap is reduced or reducing the hydraulic diameter of the discharge gap may comprise: increasing an inner spacer connected to an outer surface of the downstream nozzle, wherein the inner spacer includes an inner spacer depth; and increasing an outer spacer connected to an inner surface of the downstream nozzle, wherein the outer spacer includes an outer spacer depth, in such a method, when reducing the hydraulic diameter of the discharge gap, the method may include computing a hydraulic diameter as a function of the inner spacer depth and outer spacer depth, and a Reynolds number.

Moreover, in the method, a rotation of the axially-symmetric swirling flow is either a clockwise swirl or a counterclockwise swirl. Such a method may further comprise switching the rotation of the axially-symmetric swirling flow by re-orienting the chamber.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The embodiments herein will be better understood from the following detailed description with reference to the drawings, in which:

FIGS. 5A-5C illustrate various views of an apparatus for generating swirling flow according to an embodiment herein;

DETAILED DESCRIPTION OF PREFERRED EMBODIMENTS

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

The embodiments herein create axi-symmetric uniform flow fields in a predictable and accurately quantifiable manner while significantly reducing the pressure drop associated with historical swirl-generating devices. In conventional swirl generators, such as those which rely on a device residing in the flow stream itself (such as chevron-like devices, swirl vanes, etc.), the conventional device itself is positioned inside the pressure boundary of the flow stream thereby creating "form loss" due to the leading edges of the conventional device that are impinged by the flow stream. These edges create a type of "bluff body" that resist flow, and in turn, produce an observable and definable pressure drop. In contrast, embodiments described herein only injects a fluid into a flow stream and does not induce a form loss. Additionally, embodiments herein anticipate pressure losses within the swirl flow generator itself; for example, between the injection piping and the converged swirling flows inside of the plenum. Beyond the swirl flow generator, however, very little pressure losses are anticipated in the main stream flowing through the swirl flow generator.

Figure 4A:
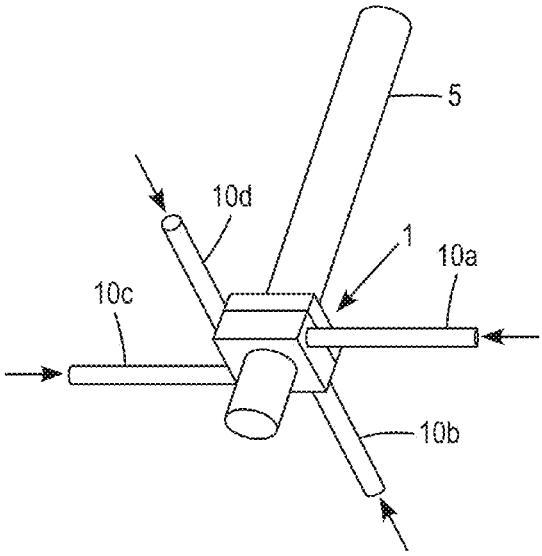
FIGS. 4A-4B illustrate various schematic diagrams of an apparatus for generating a swirling flow according to an embodiment herein.
Figure 4B:
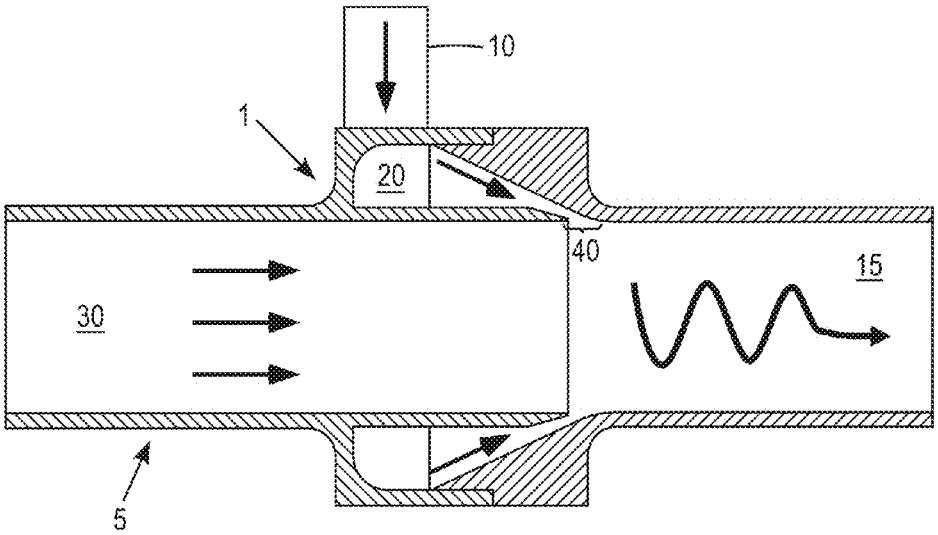

Referring now to the drawings, and more particularly to FIGS. 4A through 17, where similar reference characters denote corresponding features consistently throughout the figures, there are shown preferred embodiments. FIGS. 4A and 4B illustrate schematic diagrams of swirl flow generator 1 according to one embodiment herein. In the embodiment shown in FIG. 4A, swirl flow generator 1 is coupled to main pipe 5 and includes a plurality of injection ports 10 (e.g., injections ports 10*a*, 10*b*, 10*c* and 10*d* are shown in FIG. 4A). While swirl flow generator 1 is shown to accommodate four tangential injection ports, the subject matter disclosed herein is not so limited and single or multiple injection port embodiments are possible, with the number of multiple ports only limited by the physical dimensions of the ports themselves. FIG. 4B is a cross section of swirl flow generator 1 and main pipe 5. As shown, swirl flow generator 1 is coupled to main pipe 5 and swirl flow generator 1 includes a plenum 20 coupled to each injection port to induce a swirl into the incoming flow 30 flowing through main pipe 5 via slot 40.

As shown generally in FIGS. 4A and 4B, the present subject matter relates to a mixing apparatus and process where two miscible fluids are combined in a controlled manner. In FIGS. 4A and 4B, one fluid is represented by that of an incoming flow 30 while the other is represented by a fluid injected into the main flow via injection ports 10 to impart a predefined swirling component 15 to incoming flow 10. The fluid injected via injection ports 10 into incoming flow 30 is itself injected into plenum 20. In the exemplary embodiment shown in FIGS. 4A and 4B, four fluid streams are tangentially injected into plenum 20. Other numbers of streams can be injected without departing from the scope of the present subject matter. Critically, swirl flow generator 1 is designed to fit into a piping system and represent a low pressure drop to the overall system, yet induce a controlled, uniform, axi-symmetric swirl.

Generally, the mixing induced by the present subject matter can include but not be limited to the need to mix two miscible but not necessarily identical fluids, compositions, or reactants where controlled uniform axi-symmetric mixing is desired. In other words, swirl flow generator 1 induces a uniform and ax i-symmetric swirl, circumferentially around the discharge location (e.g., slot 40) and thereby imparting repeatable and controllable swirl. Thus, when installed, swirl flow generator 1 produces a known quantity of swirling flow from an incoming flow to produce a uniform axi-symmetric flow velocity profile at its discharge. To improve the swirl plenum performance for producing a known quantity of swirling flow, an incoming flow may be flattened using a flow straightener that produces a flattened velocity profile to swirl flow generator 1. In certain exemplary embodiments of the present subject matter, the device is configured as a continuous chemical reactor. Moreover, while main pipe 5 is illustrated as a circular pipe, other fluid channels of other shapes can be used instead of and/or in addition to the circular pipe shown as main pipe 5 without departing from the scope of the present subject matter.

FIGS. 5A-5C illustrate various views of an apparatus for generating swirling flow according to an embodiment herein. FIG. 5A is a cross section of swirl flow generator 1 and shows center chamber 100, upstream nozzle 200, downstream nozzle 300, plenum 20 and bolt assembly 400 that includes a plurality of bolts 410, nuts 420 and washers 430. In the embodiment shown, plenum 20 is formed as a space defined by the coupling of center chamber 100, upstream nozzle 200 and downstream nozzle 300. In FIG. 5A, center chamber 100, upstream nozzle 200 and downstream nozzle 300 are coupled by bolt assembly 400, but the present subject matter is not thereby limited and any fixation or coupling mechanism may be used.

FIG. 5B is a plan view of swirl flow generator 1, and according to the exemplary embodiment shown, includes eight bolt assemblies 400. While eight bolt assemblies 400 are show in FIG. 5B, swirl flow generator 1 is not limited to this number and can include more or less bolt assemblies 400 to adequately secure center chamber 100, upstream nozzle 200 and downstream nozzle 300.

FIG. 5C illustrates a cross section of slot 40 and includes gap 50, throat 60, cone 500, outer spacer 600 and inner spacer 650. Slot 40 is engineered to meet the desired swirl generation performance. As shown, gap 50 and throat 60 are formed between upstream nozzle slope 210 of upstream nozzle 200 and cone 500. The size of both gap 50 and throat 60 can be adjusted by setting the position of cone 500 using outer spacer 600 and inner spacer 650. For example, by using an outer spacer 600 and inner spacer 650 with a deeper depth, gap 50 and throat 60 become narrower than what is shown in FIG. 5C. Similar, when outer spacer 600 and inner spacer 650 are set with a shallower depth, gap 50 and throat 60 become wider than what is shown in FIG. 5C.

Figure 6A:
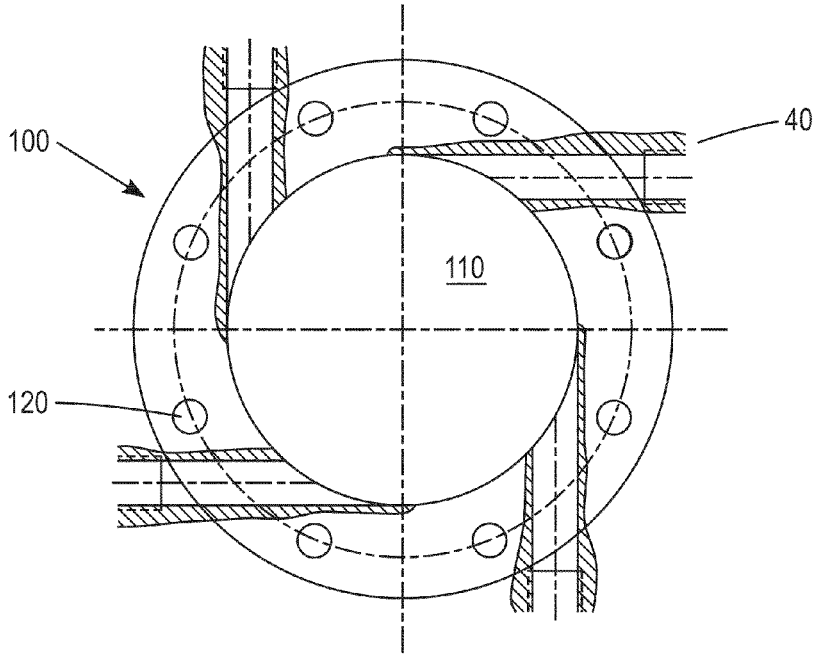
FIGS. 6A-6C illustrate various views of a center chamber according to an embodiment herein.
Figure 6B:
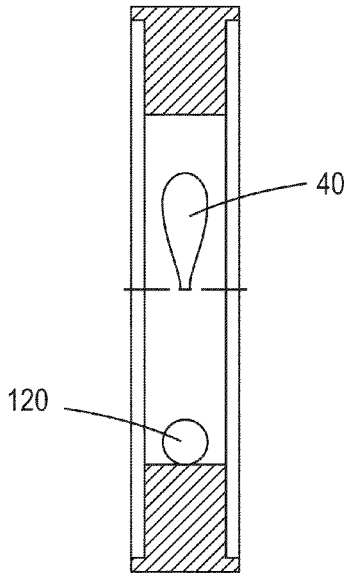
Figure 6C:
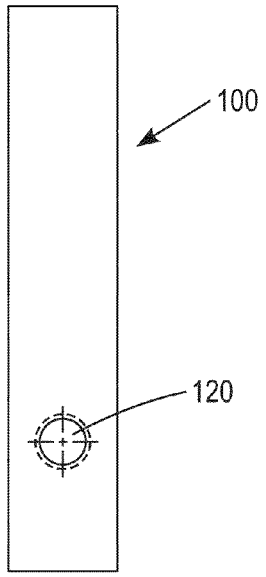

FIGS. 6A-6C illustrate various views of center chamber 100 according to an embodiment herein. For example, FIG. 6A illustrates a plan view of center chamber 100 and includes chamber 110 and a plurality of bolt holes 120. As shown in FIG. 6A is a plurality of slots 40 surrounding chamber 110. According to one embodiment herein, chamber 110 has a similar inner cross sectional area to main pipe 5 and is approximately the same cross sectional shape. For example, main pipe 5 (shown in FIGS. 4A and 4B) are approximately cylindrical in shape and chamber 110 is approximately cylindrical in shape. In addition, bolt holes 120 are preferably sized to accommodate a bolt, for example, bolt 410, but chamber 100 is not limited by this and bolt holes 110 can be of any size or shape. The plan view of center chamber 100 also illustrates a cross section of slot 40, gap 50 and throat 60. As explained in further detail below, center chamber 100 becomes part of a segmented torus-like shape (together with upstream nozzle 200 and downstream nozzle 300), where the injected flows are tangentially oriented to the segmented torus. In addition, the direction of swirl can be easily redirected from "clockwise" (CW) to "counter clockwise" (CCW) by simply "flipping" the flanged faces (e.g., reorienting respect to upstream nozzle 200 and downstream nozzle 300). FIG. 6B illustrates a side view of center chamber 100, with a bolt hole 120 visible and FIG. 6C illustrates a cross section of center chamber 10X) with a portion of slot 40 and bolt hole 120 visible.

Figure 7B:
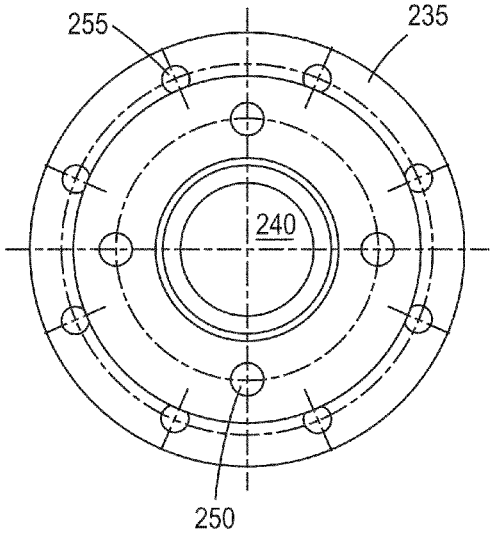
FIGS. 7A-7E illustrate various views of an upstream nozzle according to an embodiment herein.
Figure 7A:
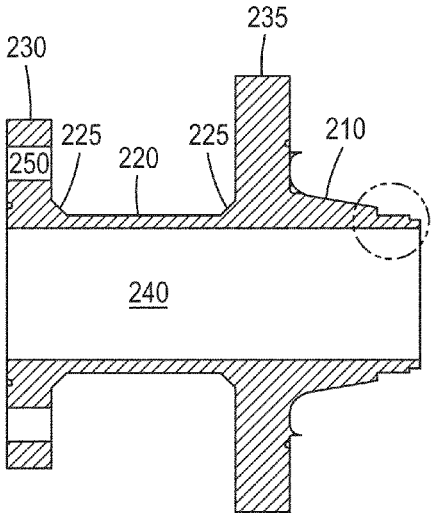

FIGS. 7A-7E illustrate various views of upstream nozzle 200 according to an embodiment herein. Upstream nozzle 200 is located upstream, and as shown in FIGS. 4A and 5A, interfaces with center chamber 100. In FIG. 7A, a cross section of upstream nozzle 200 is shown and includes upstream nozzle slope 210, upstream nozzle body 220, camfers 225, upstream nozzle end section 230, upstream nozzle mid-section 235, main channel 240, a plurality of end-section bolt holes 250 and mid-section bolt holes 255, notches 260 and 270, inner surface 280 and outer surface 290. According to one embodiment herein, upstream nozzle slope 210 is approximately 14°; however, the subject matter described herein is not limited to such a slope and upstream nozzle slope 210 may include a slope of any degree between 0° and 90°. While not shown in FIG. 7A, an exemplary embodiment of upstream nozzle end section 230 couples to an end section of main pipe 5 (e.g., via bolts, not shown). Moreover, according to one embodiment herein, main channel 240 has a similar inner cross sectional area to main pipe 5 and is approximately the same cross sectional shape. For example, main pipe 5 (shown in FIGS. 4A and 4B) is approximately cylindrical in shape and main channel 240 is approximately cylindrical in shape. In addition, bolt holes 250 and 255 are preferably sized to accommodate a bolt, for example, bolt 410, but upstream nozzle 200 is not limited by this and bolt holes 250 and 255 can be of any size or shape.

Figure 7C:
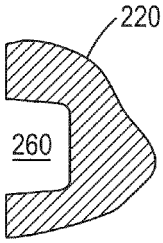
Figure 7D:
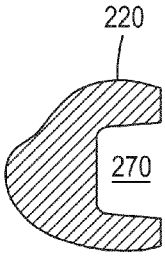

FIG. 7B is a plan view of upstream nozzle 200, and according to the exemplary embodiment shown, includes eight end-section bolt holes 250 and eight mid-section bolt holes 255. While eight mid-section bolt holes 255 are show in FIG. 7B, upstream nozzle 200 is not limited to this number and can include more or less mid-section bolt holes 255 to adequately secure center chamber 100, upstream nozzle 200 and downstream nozzle 300. End-section bolt holes 250 are similarly not limited to the shown embodiment. Additionally, FIGS. 7C and 7D are detailed views of notches 260 and 270 respectively. Notches 260 and 270 each receive an O-ring (not shown), which perform a sealing function for the flange. According to one embodiment herein, one O-ring seals upstream nozzle 200 and a second O-ring seals the downstream nozzle 300. Moreover, according to embodiments herein, the O-rings are sized differently. In addition, notches 260 and 270 match the dimensions of notches shown in FIGS. 8C and 8D.

Figure 7E:
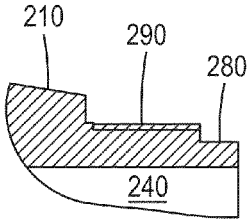

Upstream nozzle 200 can be manufactured through a variety of different methods and the interface flanging can be modified to meet the needs of the application and installation requirements. As used herein, the interface flanging of upstream nozzle 200 refers to exterior surfaces used to attach the device to a piping system. Interface flanging can take many forms, depending to the requirements of the piping system. For example, mechanical attachment to the piping system can be realized by a flange or a weld. Flanges can be procured from off-the-shelf commercial sources or they can be custom made; in either case, the flange size will assure matching inside diameter surfaces. If welded, both inlet and discharge interior weldments are ground and machined smooth to that of both the device and the matching piping inside diameter surfaces, according to embodiments herein. Properly matched flanges or smoothed weldments assure predicable swirling discharged flow fields. In contrast, conventional systems that use mis-matched dimensions produce a diametric lip condition that introduces an undesirable hydraulic disruption to the desired uniform swirl flowfield. Additionally, upstream nozzle 200 contains features used to install, insert, and secure outer spacer 600 and inner spacer 650. For example, as shown in FIG. 7E, upstream nozzle 200 includes outer surface 290 and inner surface 280 that interface with outer spacer 600 and inner spacer 650, respectively.

Figure 8B:
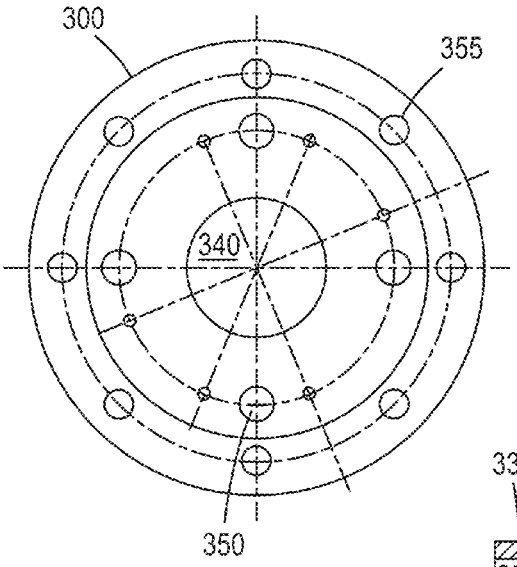
FIGS. 8A-8D illustrate various views of a downstream nozzle according to an embodiment herein.
Figure 8A:
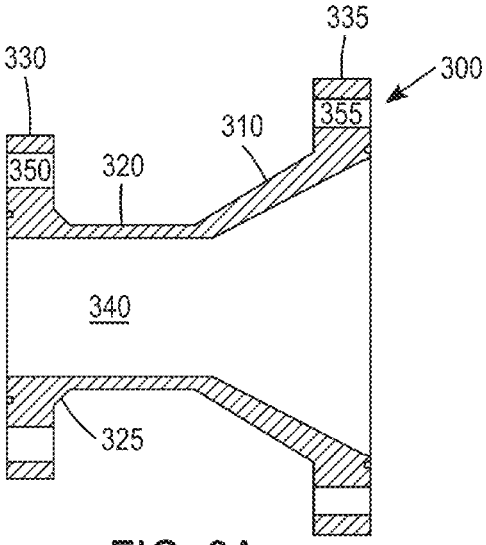

FIGS. 8A-8D illustrate various views of downstream nozzle 300 according to an embodiment herein. In FIG. 8A, a cross section of downstream nozzle 300 is shown and includes downstream nozzle slope 310, downstream nozzle body 320, camfers 325, downstream nozzle end section 330, downstream nozzle head section 335, main channel 340, a plurality of end-section bolt holes 350 and head section bolt holes 355, and notches 360 and 370. According to one embodiment herein, downstream nozzle slope 310 is approximately 27°; however, the subject matter described herein is not limited to such a slope and downstream nozzle slope 310 may include a slope of any degree between 0° and 90°. While not shown in FIG. 8A, an exemplary embodiment of downstream nozzle end section 330 attaches bolts to an end section of main pipe 5. Moreover, according to one embodiment herein, main channel 340 has a similar inner cross sectional area to main pipe 5 and is approximately the same cross sectional shape. For example, main pipe 5 (shown in FIGS. 4A and 4B) is approximately cylindrical in shape and main channel 340 is approximately cylindrical in shape. In addition, bolt holes 350 and 355 are preferably sized to accommodate a bolt, for example, bolt 410, but downstream nozzle 300 is not limited by this and bolt holes 350 and 355 can be of any size or shape.

Figure 8C:
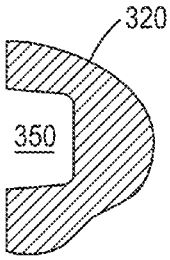
Figure 8D:
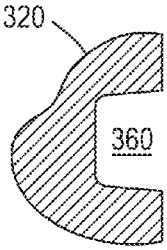

FIG. 8B is a plan view of downstream nozzle 300, and according to the exemplary embodiment shown, includes eight end section bolt holes 350 and eight head section bolt holes 355. While eight end section bolt holes 350 are show in FIG. 8B, downstream nozzle 300 is not limited to this number and can include more or less bolt end section bolt holes 350 to adequately secure center chamber 100, upstream nozzle 200 and downstream nozzle 300. Similarly, head section bolt holes 355 is not limited to the embodiment shown in FIG. 8B. Additionally, FIGS. 8C and 8D are detailed views of notches 360 and 370, respectively. As described previously, notches 360 and 370 each receive an O-ring (not shown), which perform a sealing function for the flange. According to one embodiment herein, one O-ring seals upstream nozzle 200 and a second O-ring seals the downstream nozzle 300. Moreover, according to embodiments herein, the O-rings are sized differently. In addition, notches 360 and 370 match the dimensions of notches shown in FIGS. 7C and 7D.

Downstream nozzle 300 can be manufactured through a variety of different methods and the interface flanging can be modified to meet the needs of the application and installation requirements. Interface flanging can take many forms, depending to the requirements of the piping system. For example, mechanical attachment to the piping system can be realized by a flange or a weld. Flanges can be procured from off-the-shelf commercial sources or they can be custom made; in either case, the flange size will assure matching inside diameter surfaces. If welded, both inlet and discharge interior weldments are ground and machined smooth to that of both the device and the matching piping inside diameter surfaces, according to embodiments herein. Properly matched flanges or smoothed weldments assure predicable swirling discharged flow fields. In contrast, conventional systems that use mis-matched dimensions produce a diametric lip condition that introduces an undesirable hydraulic disruption to the desired uniform swirl flowfield.

Figure 9A:
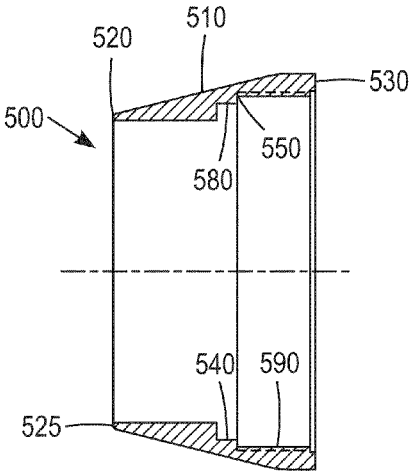
FIGS. 9A-9B illustrate various views of a cone according to an embodiment herein.
Figure 9B:
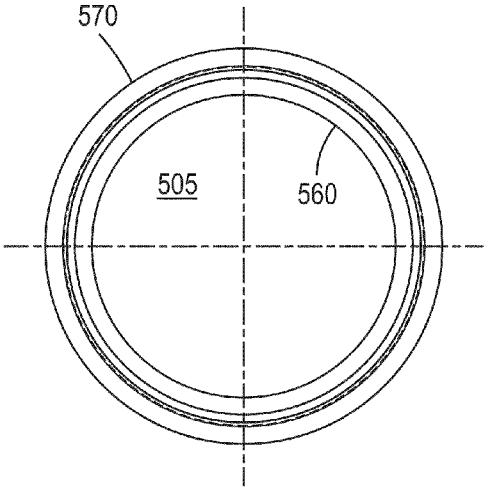

FIGS. 9A-9B illustrate various views of cone 500 according to an embodiment herein. As shown in FIG. 9A, cone 500 includes a cone slope 510, leading end 520, tip 525 of leading end 520, tail end 530, notches 540 and 550, inner surface 580 and outer surface 590. According to one embodiment herein, cone slope 510 is approximately 14°; however, the subject matter described herein is not limited to such a slope and cone slope 510 may include a slope of any degree between 0° and 90°. The slope of cone slope 510, with downstream slope 210, together form throat 60 (e.g., shown in FIG. 5C). Similarly, leading end 520 is tapered, and together with upstream nozzle body 220, form gap 50. In addition, depending on different embodiments, notch 540 may interface with inner spacer 650 (e.g., as shown in the embodiment of FIG. 5C) or directly with upstream nozzle 200 at inner surface 280 in an embodiment where spacers are not used (not shown). Notch 550 may also interface with inner spacer 650 (e.g., as shown in the embodiment of FIG. 5C) or directly with upstream nozzle 200 at inner surface 280 in an embodiment where spacers are not used (not shown). Tail end 530 may interface with outer spacer 600 (e.g., as shown in the embodiment of FIG. 5C) or directly with downstream nozzle 200 at outer surface 290 in an embodiment where spacers are not used (not shown). In addition, as shown in the embodiment of FIG. 5C, inner surface 580 is in direct contact with incoming flow 30, while a portion of outer surface 590 is in contact with downstream nozzle 200 at outer surface 290.

FIG. 9B illustrates a plan view of cone 500 and includes inner perimeter 560 and outer perimeter 570. Inner perimeter 560 is defined by tip 525 of cone leading end 520. According to one embodiment herein, inner perimeter 560 defines a similar inner cross sectional area to main pipe 5 and is approximately the same cross sectional shape. For example, main pipe 5 (shown in FIGS. 4A and 4B) are approximately cylindrical in shape and inner perimeter 560 is approximately circular in shape. Outer perimeter 570 is defined by tail end 530 and, according to the embodiment shown in FIG. 9B, is approximately the same cross sectional shape as inner perimeter 560.

Figure 10A:
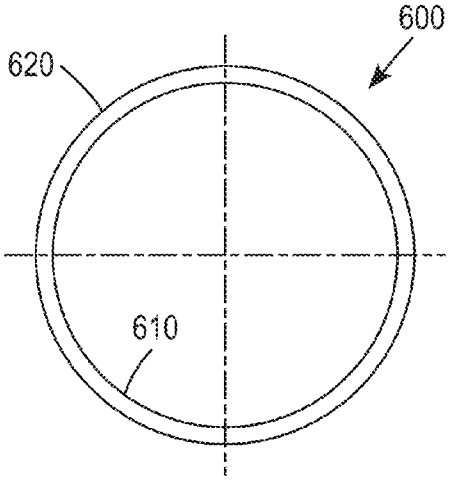
FIGS. 10A-10B illustrate various views of an outer spacer according to an embodiment herein.
Figure 10B:
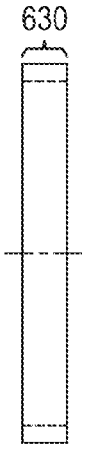

FIGS. 10A-10B illustrate various views of outer spacer 600 according to an embodiment herein. FIG. 10A illustrates a plan view of outer spacer 600 and includes an inner perimeter 610 and an outer perimeter 620. According the embodiment shown in FIGS. 10A and 5C, inner perimeter 610 defines a larger inner cross sectional area to main pipe 5 and is approximately the same cross sectional shape. For example, main pipe 5 (shown in FIGS. 4A and 4B) is approximately cylindrical in shape and inner perimeter 610 is approximately circular in shape. As shown also in FIGS. OA and SC, outer perimeter 620 also defines a larger area than the inner cross sectional area of main pipe 5. Additionally, FIG. 10B shows that outer spacer 600 includes a depth 630, where depth 630 is used to adjust the position of cone 500.

Figure 11A:
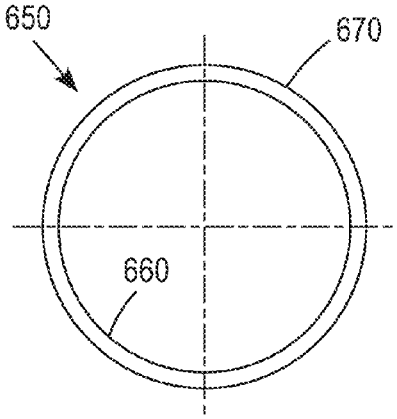
FIGS. 11A-11B illustrate various views of an inner spacer according to an embodiment herein.
Figure 11B:
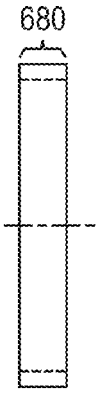
Figure 12:
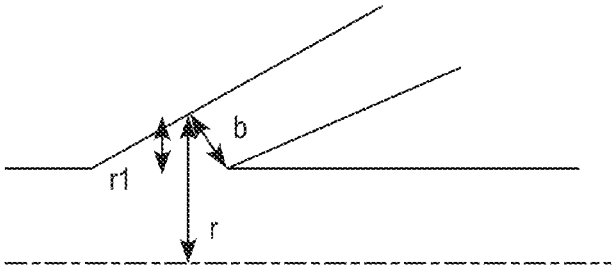
FIG. 12 illustrates a schematic diagram of a slot according to an embodiment herein.
Figure 13:
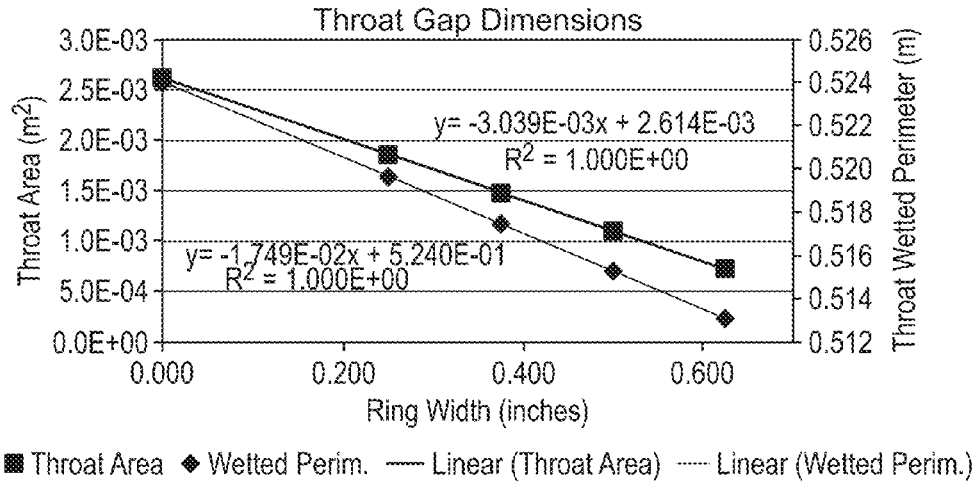
FIG. 13 illustrates a chart of different throat and gap dimensions and corresponding inner/outer spacer dimensions.

FIGS. 11A-11B illustrate various views of inner spacer 650 according to an embodiment herein. FIG. 11A illustrates a plan view of inner spacer 650 and includes an inner perimeter 660 and an outer perimeter 670. According to the embodiment show in FIGS. 11A and 5C, inner perimeter 660 defines a similar inner cross sectional area to main pipe 5 and is approximately the same cross sectional shape. For example, main pipe 5 (shown in FIGS. 4A and 4B) is approximately cylindrical in shape and inner perimeter 660 is approximately circular in shape. As shown in FIGS. 11A and 5C, outer perimeter 670 defines a larger area than the inner cross sectional area of main pipe 5. Additionally, FIG. 11B shows that inner spacer 650 includes a depth 680, where depth 680 is used to adjust the position of cone 500.

Preferably, outer spacer 600 and inner spacer 650 are of equal depth and adjustments in their collective depth permit throat 60 of swirl flow generator 1 to be adjusted to wider or smaller hydraulic diameters. Alternatively, swirl flow generator 1 can be assembled without outer space 600 and inner spacer 650. In its "ring-less" assembled condition, throat 60 is at its widest, i.e., has its largest hydraulic diameter. Thus, as wider spacing pairs are included in the assembled swirl flow generator 1, the discharge throat narrows and thus the hydraulic diameter is reduced.

As described above, swirl flow generator 1 is an apparatus used to induce an axi-symmetric swirling flow to an incoming normalized and uniform flow to a conventional pipe (e.g., main pipe 5). In many applications, mixing and stirring with a uniform axi-symmetric swirling flow is a necessary attribute. Swirl flow generator 1 induces a uniform and axi-symmetric swirl, circumferentially around the discharge opening (e.g., slot 40), thus imparting repeatable and the controllable swirl and mixing condition of interest. Swirl flow generator 1 also performs the swirl injection at a low pressure drop in comparison to a more traditional swirl vane method. This is in contrast to prior art methods and devices that to do not provide uniform axi-symmetric swirling flow and are difficult to effectively meter and adjust.

The ability to precisely control the swirl injection flow rate out of plenum 20 is achieved by first knowing the tangential injection of flow rate into plenum 20. This flow in-turn creates a rotating motion inside and plenum 20 uniformly mixes the flow by turbine-like motion and circumferentially discharges the flow into incoming flow 30 through slot 40. Moreover, slot 40 is sized to meet desired swirl generation performance requirements. The ability to apply multiple ports adds mass flow to plenum 20 itself, but also permits those injections to contain reactants. With reactants added to plenum 20, the plenum itself becomes a continuously stirred tank reactor (CSTR) with its discharge containing the product of the reactants. These discharge products can in-turn react with reactants contained in incoming flow 30, once it is discharged through slot 40. In other words, according to one embodiment herein, the reaction process is segmented into two stages—one inside of plenum 20 and the other located at the slot discharge-to-main flow stirring region. The benefit of such embodiment is clear when reactants require special treatment (e.g., special kinetic or thermal treatment) or when the product's molecular and particulate size attributes are best defined by staged reaction methods. For example, plenum 20 could be constructed using special surfaces that catalytically promote the reaction or could be constructed to include a thermal jacket, where heat could be removed from the plenum region or could be added, depending upon the reaction requirements.

Swirl flow generator 1 can be installed in its assembled condition into any piping system (preferably using standard flanges), or it could also be welded into a piping system as a more permanent but less serviceable installation. The design permits either CW or CCW direction of swirling flows by simply re-orienting central chamber 110, as described above. Materials used to manufacture swirl flow generator 1 can be selected and properly sized to match to any piping system, including the use of polymer or ceramic materials. For example, according to one embodiment, swirl flow generator 1 is fabricated using stainless steel materials.

The intensities of the swirling flow of swirl flow generator 1 are attributable to the width of slot 40, gap 50 and throat 60. A significant benefit of the disclosed subject matter is knowing the intensity of the swirl and/or being able to reliably predict the swirl intensity metrics. In particular, the subject matter disclosed herein includes two basic swirl metrics: a Swirl Momentum Flux Ratio (SMFR) and a swirl number (SN). The SMFR is defined as the square of the ratio of momentum flux through the tangential inlets to that of the main inlet pipe:

$$\text{Swirl Momentum Flux Ratio} = SMFR = \frac{m_{slot}^2}{m_T^2}\frac{A}{A_{slot}}$$

where:

SMFR=swirl momentum flux ratio=$M_{slot}/M_t$, for a tangential injection swirl generator.

A=the upstream inlet flow area ($m^2$)

$A_{slot}$=the throat or gap flow area ($m^2$)

$m_T$=upstream mass flow of the inlet flow (kg/s)

$m_{slot}$=total mass flow injected into plenum (kg/s)

The swirl number (SN) is simply a ratio of velocities of a tangential jet (Vjet) to the inlet flow velocity (Vt)=Vjet/VT. Thus, for the dual port swirl generator, the SN jet uses either the upper or lower velocity (assuming they are equally split) in the numerator.

As described above, the flow area changes in swirl flow generator 1 as outer spacer 600 and inner spacer 650 widths change. Table 1, shown below, expresses this change in flow area (along with FIG. 12, in reference to Table 1) that includes the wetted perimeter. Table 1 illustrates an inter-relationship between ring width (e.g., depth 630 and 680), throat gap, throat area and wetted perimeter. Data from Table 1 is plotted in FIG. 13. Thus, a hydraulic diameter can be computed as a function of spacer width and a Reynolds number ($N_{re}$) can be assessed for each design instance (see Table 2 below). Table 2 illustrates an inter-relationship between swirl mass flux ratio, swirl number, Reynolds number, throat area and velocity. These types of computations can be extended for a variety of SMFR goals (see Table 3 below). Table 2 illustrates an inter-relationship between ring width (e.g., depth 630 and 680) and swirl mass flux ratio.

TABLE 1

| Ring Width | Throat gap b (in) | Circum/2 (in) | r1 (in) | r = circum + r1 (in) | Throat Area ($in^2$) | Wetted Perimeter (in) | Hydraulic Diameter (in) |
|---|---|---|---|---|---|---|---|
| 0 | 0.393 | 1.594 | 0.095 | 1.698 | 2.618E−3 | 0.5240 | 1.999E−3 |
| 0.25 | 0.280 | 1.594 | 0.068 | 1.662 | 1.849E−3 | 0.5196 | 1.424E−3 |
| 0.375 | 0.224 | 1.594 | 0.054 | 1.648 | 1.469E−3 | 0.5175 | 1.136E−3 |

TABLE 1-continued

| Ring Width | Throat gap b (in) | Circum/2 (in) | r1 (in) | r = circum + r1 (in) | Throat Area (in$^2$) | Wetted Perimeter (in) | Hydraulic Diameter (in) |
|---|---|---|---|---|---|---|---|
| 0.5 | 0.167 | 1.594 | 0.040 | 1.635 | 1.093E−3 | 0.5153 | 8.484E−3 |
| 0.625 | 0.110 | 1.594 | 0.027 | 1.621 | 7.193E−4 | 0.5131 | 5.608E−3 |

TABLE 2

| SN = Factor = 0.6803 | Ring Width = 0.625 | | | | | | | | |
|---|---|---|---|---|---|---|---|---|---|
| | Velocity (m/s) | Throat A, m$^2$ | Q, m$^3$/s | M, kg/s | % Total | $Q_{port}/Q_{inlet}$ | $N_{re}$ | SMFR $M_f/M_T$ | SN $U_f/U_{in}$ |
| Ring = 0.625 | 4.9765 | 7.146E−04 | 0.00356 | 3.55 | 9.25 | 10.2% | 2.773E+04 | 0.06935 | 0.6803 |
| Intel | 7.3151 | 4.769E−03 | 0.03489 | 3.48 | 90.75 | | 5.701E+05 | | |
| Discharge | 8.0607 | 4.769E−03 | 0.03845 | 3.84 | | | 6.282E+05 | | |
| | | Slot Q = | 56.37 | gpm | | | Port 5.409E+04 | | |
| | | Port Velocity | 2.5842 | m/s | | | | | |

TABLE 3

| Ring Width (in) | BC Input | SMFR = 0.069 | SMFR = 0.236 | SMFR = 0.802 |
|---|---|---|---|---|
| 0.625 | SN | 0.6803 | 1.2544 | 2.3131 |
| | Port V (m/s) | 2.5842 | 4.7651 | 8.7864 |
| | Throat Q (gpm) | 56.37 | 103.94 | 191.66 |
| 0.5 | SN | 0.5497 | 1.0136 | 1.8690 |
| | Port V (m/s) | 3.1982 | 5.8971 | 10.8738 |
| | Throat Q (gpm) | 69.8 | 128.6 | 237.2 |
| 0.375 | SN | 0.4736 | 0.8733 | 1.6104 |
| | Port V (m/s) | 3.7119 | 6.8444 | 12.6205 |
| | Throat Q (gpm) | 81.0 | 149.3 | 275.3 |
| 0.25 | SN | 0.4223 | 0.7788 | 1.4360 |
| | Port V (m/s) | 4.1627 | 7.6757 | 14.1533 |
| | Throat Q (gpm) | 90.8 | 167.4 | 308.7 |
| 0 | SN | 0.3557 | 0.6559 | 1.2094 |
| | Port V (m/s) | 4.8425 | 9.1135 | 16.8045 |
| | Throat Q (gpm) | 107.8 | 198.8 | 366.6 |

Figure 14:
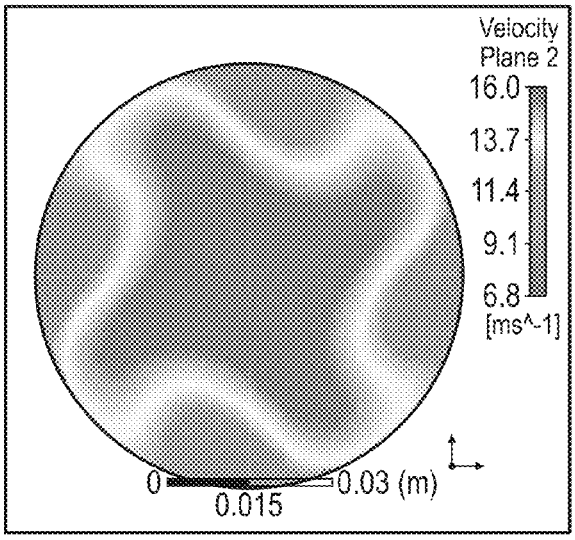
FIG. 14 illustrates a contour plot of an apparatus for generating a swirling flow according to an embodiment herein.
Figure 15:
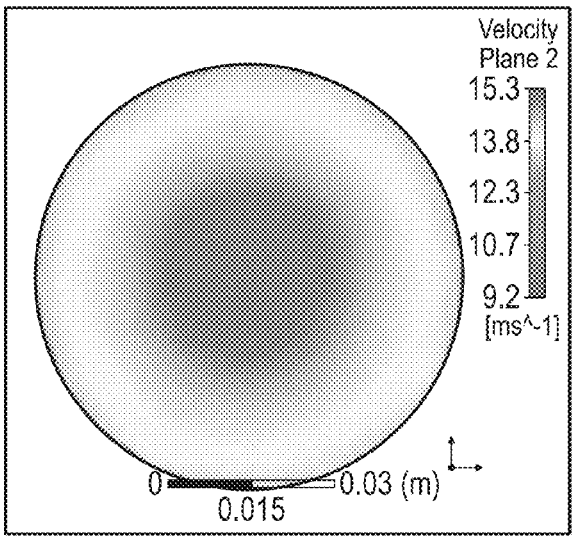
FIG. 15 illustrates a streamline plot of an apparatus for generating a swirling flow according to an embodiment herein.

In addition, computational fluid dynamics (CFD) analyses have been done on the disclosed subject matter with SMFR value between −0.069 to −0.8. The results are shown in FIGS. 14 and 15. FIG. 14 illustrates a contour plot of an apparatus for generating swirling flow according to an embodiment herein. As discussed above, a significant benefit of the disclosed subject matter is a uniform swirl pattern. The plot of FIG. 14 is taken 1.111 m from a swirl flow generator (e.g., one according to swirl flow generator 1) and shows a significant improvement in uniformity of the swirl pattern compared to a prior art swirl pattern (e.g., the swirl pattern of the Quad-Port tangential injection device shown in FIG. 2). Similarly. FIG. 15 illustrates a streamline plot of an apparatus for generating swirling flow according to an embodiment herein and also shows a significant improvement in uniformity of the swirl pattern compared to a prior art swirl pattern (e.g., the swirl pattern of the Quad-Port tangential injection device shown in FIG. 1).

Figure 1:
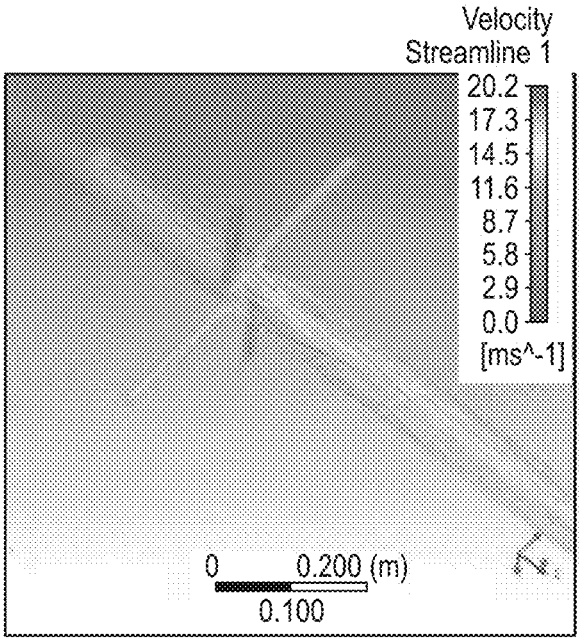
FIG. 1 Prior Art
FIG. 1 illustrates a schematic diagram of a conventional tangential injection port device.
Figure 2:
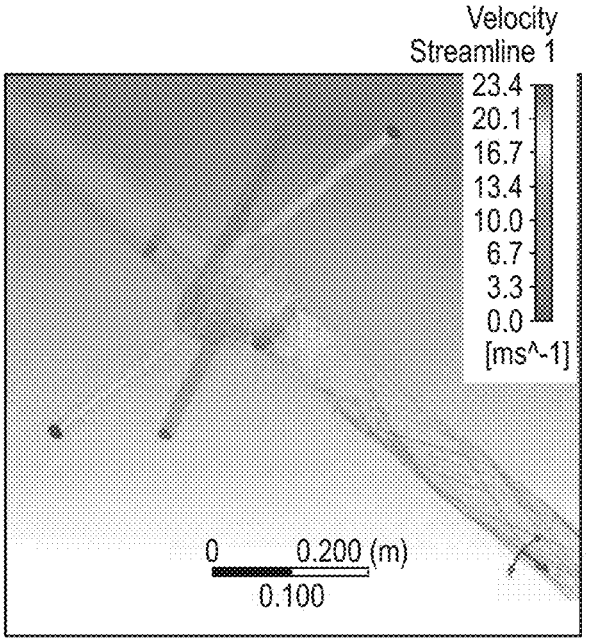
FIG. 2 Prior Art
FIG. 2 illustrates a typical contour plot of a conventional tangential injection port device.
Figure 3:
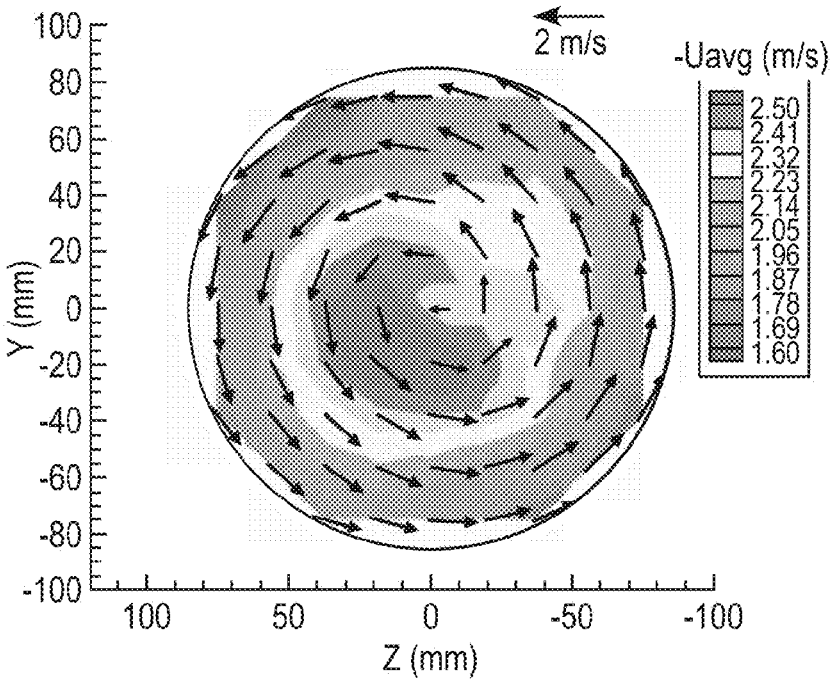
FIG. 3 Prior Art
FIG. 3 illustrates asymmetrical swirl flow from a conventional swirl vane.
Figure 16:
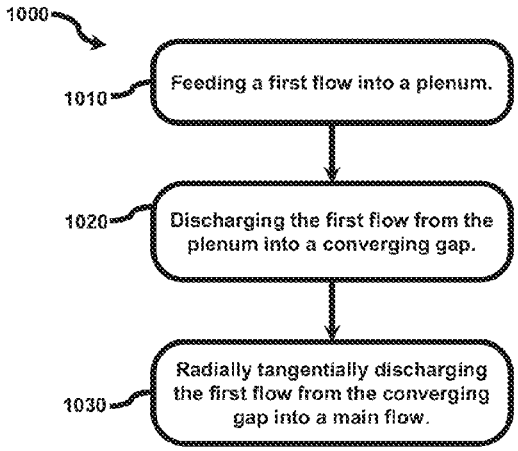
FIG. 16 is a flow diagram illustrating a method for generating a swirling flow according to an embodiment herein.

FIG. 16 illustrates a flow diagram according to an embodiment herein. Method 1000 shown in FIG. 16, at step 1010, includes feeding a first flow into a plenum (e.g., plenum 20). Step 1020 includes discharging the first flow from the plenum into a converging gap (e.g., slot 40). Additionally, step 1030 includes radially tangentially discharging the first flow from the converging gap into a main flow (e.g., incoming flow 30, as shown in FIG. 1).

Figure 17:
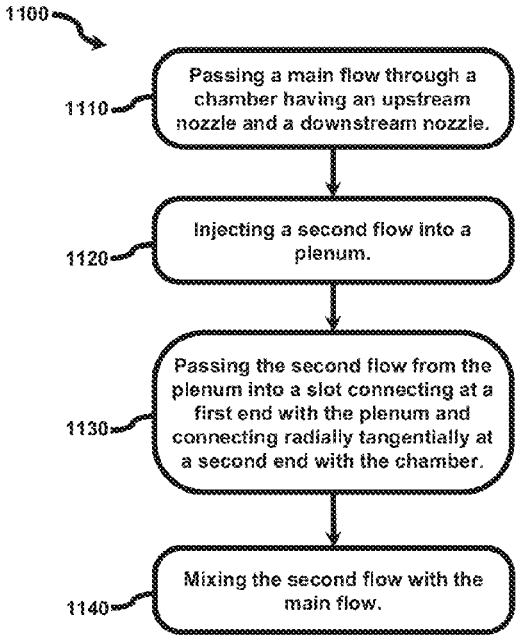
FIG. 17 is another flow diagram illustrating a method for generating a swirling flow according to an embodiment herein.

FIG. 17 illustrates another flow diagram according to an embodiment herein. Method 1100 shown in FIG. 17, at step 1110, includes passing a main flow (e.g., incoming flow 30) through a chamber having an upstream nozzle (e.g., upstream nozzle 200) and a downstream nozzle (e.g., downstream nozzle 300). Step 1120 includes injecting a second flow into a plenum (e.g., plenum 20). Step 1130 includes passing the second flow from the plenum into a slot (e.g., slot 40) connecting at a first end with the plenum and connecting radially tangentially at a second end with the chamber (see e.g., FIG. 6A). Moreover, step 1140 includes mixing the second flow with the main flow (e.g., as shown in FIG. 1).

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

What is claimed is:

1. A method of creating an axially-symmetric swirling flow, comprising:

passing a main flow lacking axially-symmetric swirling flow through a chamber having an upstream nozzle and a downstream nozzle;

injecting a second flow into a plenum;

passing the second flow from the plenum into a slot connecting at a first end with the plenum and connecting radially tangentially at a second end with the chamber;

discharging the second flow through the slot and into the main flow, wherein the step of discharging the second flow into the main flow mixes the second flow with the main flow to impart a predefined swirling component to the main flow to generate an axially-symmetric uniform flow field;

wherein a rotation of the axially-symmetric swirling flow is either a clockwise swirl or a counterclockwise swirl, and further comprising switching the rotation of the axially-symmetric swirling flow by re-orienting the chamber.

2. The method of claim 1, further comprising injecting the second flow into the plenum in a direction perpendicular to the main flow.

3. The method of claim 1, further comprising reducing a hydraulic diameter of the downstream nozzle.

4. The method of claim 1, further comprising adding a first chemical reactant to the plenum.

5. The method of claim 4, further comprising adding a second chemical reactant to the main flow.

6. The method of claim 1, further comprising increasing a velocity of the axially-symmetric swirling flow by reducing a hydraulic diameter of a discharge gap.

7. The method of claim 6, wherein reducing the hydraulic diameter of the discharge gap comprises:

increasing a dimension of an inner spacer connected to an outer surface of the downstream nozzle, wherein the inner spacer includes an inner spacer depth; and increasing a dimension of an outer spacer connected to an inner surface of the downstream nozzle, wherein the outer spacer includes an outer spacer depth.

8. The method of claim 7, further comprising computing the hydraulic diameter as a function of the inner spacer depth and outer spacer depth, and a Reynolds number.

9. The method of claim 1, wherein the second end of the slot includes an adjustable converging discharge gap.

* * * * *